US008240378B2

(12) United States Patent
Sonne et al.

(10) Patent No.: US 8,240,378 B2
(45) Date of Patent: Aug. 14, 2012

(54) DOWNHOLE CHARACTERIZATION OF FORMATION FLUID AS A FUNCTION OF TEMPERATURE

(75) Inventors: Carsten Sonne, Birkerod (DK); Anthony R. H. Goodwin, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 502 days.

(21) Appl. No.: 12/352,074

(22) Filed: Jan. 12, 2009

(65) Prior Publication Data

US 2010/0006284 A1 Jan. 14, 2010

Related U.S. Application Data

(60) Provisional application No. 61/022,971, filed on Jan. 23, 2008.

(51) Int. Cl.
*E21B 47/06* (2006.01)
*E21B 49/08* (2006.01)
*E21B 49/10* (2006.01)

(52) U.S. Cl. ..... 166/264; 166/250.01; 166/302

(58) Field of Classification Search ..... 166/250.01, 166/264, 302, 248

See application file for complete search history.

(56) References Cited

U.S. PATENT DOCUMENTS

| | | | | |
|---|---|---|---|---|
| 6,630,357 | B2 | 10/2003 | Mirotchnik et al. | |
| 6,755,246 | B2 | 6/2004 | Chen et al. | |
| 6,794,864 | B2 | 9/2004 | Mirotchnik et al. | |
| 7,194,902 | B1 | 3/2007 | Goodwin et al. | |
| 7,222,671 | B2 | 5/2007 | Caudwell et al. | |
| 2003/0102123 | A1 * | 6/2003 | Wittle et al. | 166/248 |
| 2007/0119244 | A1 | 5/2007 | Goodwin et al. | |
| 2009/0032259 | A1 * | 2/2009 | DiFoggio et al. | 166/302 |

FOREIGN PATENT DOCUMENTS

| | | |
|---|---|---|
| GB | 2431673 | 5/2007 |
| WO | WO2006094694 | 9/2006 |

OTHER PUBLICATIONS

Assael, M.J. et al., Correlation and Prediction of Dense Fluid Transport Coefficients, International Journal of Themophysics, vol. 13, No. 2, 1992, pp. 269-281.

Dymond, J.H., The Interpretation of Transport Coefficients on the Basis of the Van Der Waals Model, Physica 75, 1974, pp. 100-114.

* cited by examiner

*Primary Examiner* — Brad Harcourt
(74) *Attorney, Agent, or Firm* — David J. Smith

(57) ABSTRACT

A fluid analysis tool, and related method, comprising means for selectively varying a temperature of fluid received in a tool from a subterranean formation, means for measuring a temperature and a thermophysical property of the fluid received in the tool, and means for determining a relationship between the measured temperature and the measured thermophysical property of the fluid received in the tool.

9 Claims, 6 Drawing Sheets

DOWNHOLE CHARACTERIZATION OF FORMATION FLUID AS A FUNCTION OF TEMPERATURE

CROSS-REFERENCE TO RELATED APPLICATIONS

This application claims the benefit of U.S. Provisional Application No. 61/022,971, entitled "DOWNHOLE CHARACTERIZATION OF FORMATION FLUID AS A FUNCTION OF TEMPERATURE," filed Jan. 23, 2008, the disclosure of which is hereby incorporated herein by reference.

BACKGROUND OF THE DISCLOSURE

As is well-known in the art, thermophysical properties of underground formation fluids (e.g., hydrocarbons) vary with pressure, temperature and chemical composition. The thermophysical properties of interest to the petroleum industry include, but are not limited to, viscosity, density, thermal conductivity, heat capacity and mass diffusion. These properties at least partially govern the transport of hydrocarbons in the underground formation, and consequently, the recovery processes of the formation fluid from the formation. Thus, it is desirable to characterize formation fluid at a plurality of pressures and/or temperatures for zones within reservoirs.

Currently, this characterization may be carried out on fluid samples captured by a downhole sampling tool lowered in a wellbore and brought back to the surface. This characterization is often commonly referred to as PVT laboratory analysis. However, the surface analysis may have several limitations. In particular, as the fluid sample is brought back to the surface, the sample may undergo physical transformation (e.g., phase transitions) and some components (e.g., gases) may escape the sample. Thus, the PVT laboratory analysis may lead to approximate results. Moreover, the PVT laboratory analysis results are available once the sampling tool has been retrieved to the surface. However, these results may be used to advantage when the sampling tool is still in the wellbore, for example to design and execute subsequent sampling operations. Retrieving the sampling tool from the wellbore, analyzing the captured samples and lowering again a sampling tool in the wellbore delays the acquisition of critical information about the underground formation fluid and increases the cost of characterizing the underground formation fluid. Furthermore, the number of samples that can be brought to and analyzed at the surface is limited, and therefore the sampling tool may have to be lowered several times in the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
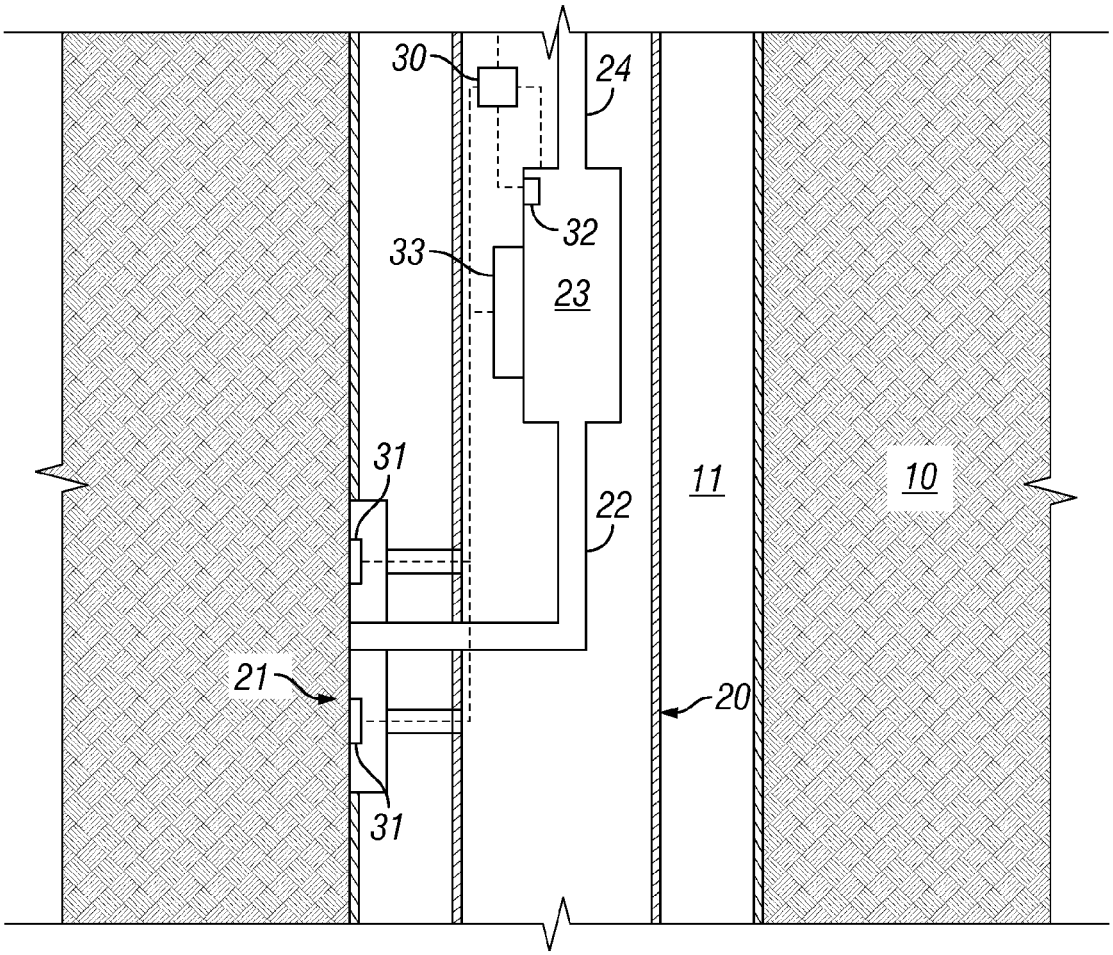
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of a fluid analysis tool 20 according to one or more aspects of the present disclosure, wherein the tool 20 has been lowered in a wellbore 11 penetrating an underground formation 10. The tool 20 could be conveyed in the wellbore 11 by wire-line, or drill-pipe, or coiled tubing or any other means used in the industry. The tool 20 is provided with a probe assembly 21 that, as shown in FIG. 1, can be extended towards a wall of the wellbore 11 and establish an exclusive fluid communication between the formation 10 and components in the tool 20. Under action of a pump or a drawdown piston (not shown), fluid may be extracted from the formation 10 and into the tool 20 through a flowline 22. Formation fluid may then flow into a viscometer chamber 23 that can be selectively sealed at both ends to prevent fluid flow. The viscometer chamber 23 comprises a viscometer (not shown separately) and a thermometer 32 communicating with the fluid in the viscometer chamber 23. The viscometer may be as described in U.S. Pat. Nos. 7,194,902 and/or 7,222,671, which are both hereby incorporated by reference herein in their entirety. The chamber 23 preferably contains a pressure sensor (see FIG. 4). Under action of a pump or a drawdown piston (not shown), the fluid may be ejected from the chamber 23 through flowline 24, and either dumped into the wellbore 11 or collected in a sample bottle (not shown) for further analysis at the surface.

In some cases, the tool 20 shown in FIG. 1 may be used in underground formations that contain unconventional resources such as heavy oil (and by some definitions also bitumen). For example, the exemplary tool 20 shown in FIG. 1 may be configured for use with underground formations containing heavy oil that are liquids at reservoir temperature, that is, for formations containing oils with viscosity lower than about 10,000 cP according to United Nations definitions. In these cases, the mobilization of the oil may be efficiently effected by increasing the formation temperature in the vicinity of the probe. The temperature increase reduces the viscosity of the oil to an appropriate level (for example, 100 cP) for sampling in existing downhole fluid sampling tools. Thus, the probe assembly 21 of the tool 20 is advantageously fitted with means for increasing the temperature of the formation fluid. As shown, the means for increasing the temperature may comprise one or more electromagnetic transducers 31 configured to emit energy into the formation at a frequency range including frequencies between DC and several GHz.

It should be understood that the means for increasing the temperature and thus the tool 20 as shown in FIG. 1 may be also used to advantage in reservoirs other than heavy oil reservoirs. For example, heating a formation containing a gas condensate may facilitate the acquisition of a single phase (representative) sample. Also, while the probe assembly 21 is shown fitted with electromagnetic transducers for increasing the temperature of the formation fluid, other implementations may alternatively use ultrasonic transducers or heated pads applied against the wellbore wall to mobilize the formation fluid. Further, the tool 20 may comprise drilling or other perforating devices for drilling a hole into the formation about the inlet of the probe assembly 21. Additionally, the tool 20 may comprise heat pipes that can be inserted into the hole drilled into the formation. Still further, other means for increasing the mobility of the formation fluid may be deployed in the wellbore, such as diluents and/or surfactants, especially if composition change resulting from the mixture with the pristine oil is reversible. Diluents may selectively be injected based on the magnitude of the fluid viscosity, for example, when sampling oil having a viscosity between 1,000 and 10,000 mPa·s approximately.

The chamber 23 may be or comprise a thermally insulated chamber (e.g., a calorimeter) that can be cooled (or heated) by a heat pump 33 or the like. The heat pump 33 may comprise a Stirling engine, a thermo-acoustic refrigerator, a vapor-compression refrigerator, and/or a thermo-electric pump (e.g., utilizing the Peltier effect), among others. In some applications, a thermo-electric pump is preferred because reversal electrical current provides heating instead of cooling.

As mentioned previously, the chamber 23 may house a viscometer (not shown separately in FIG. 1). The viscometer may be implemented with a flowline nuclear magnetic resonance (NMR) sensor, with a vibrating wire in a magnetic field (VW) (see, for example, U.S. Pat. Nos. 7,194,902 and 7,222,671), and/or with a resonating element such as a density/viscosity rod (DV-ROD) (see, for example, Pat. Pub. No. WO 2006/094694).

The tool 20 may also comprise a controller 30, optionally disposed downhole (as shown in FIG. 1). However, the controller 30 may be partially or entirely disposed at the surface. The controller 30 is programmed to retrieve, store and analyze data generated by the viscometer disposed in the chamber 23, the thermometer 32, and/or other downhole sensors (e.g., one or more pressure sensors). The controller 30 may execute commands that cause the tool 20 to carry out one or more aspects of the method described in relation to FIG. 2. The controller 30 may be configured to control the heat pump 33. For example, the controller 30 may turn the heat pump 33 on or off, vary the intensity of cooling or heating provided by the heat pump, and/or switch from heating to cooling the formation fluid, thereby varying and otherwise controlling the temperature of the fluid in the chamber 23. Alternatively, or additionally, the controller 33 may vary the temperature of the fluid flowing in the flowline 22 by controlling the electromagnetic transducers 31. Thus, the controller 30 may act as a thermostat. In some cases, the controller 30 may control the heat pump 33 and/or the electromagnetic transducers 31 based on data collected from the thermometer 32 and/or other sensors.

The viscometer container 23 and the nearby flow-lines may be thermally isolated from the remaining tubulars and tool with thermally insulating material. This may be required to reduce the power consumption of the heating/cooling system deployed on container 23 and increase the ultimate temperature difference achievable between the chamber 23 and surrounding borehole and formation temperature for the applied heating/cooling power.

Figure 2:
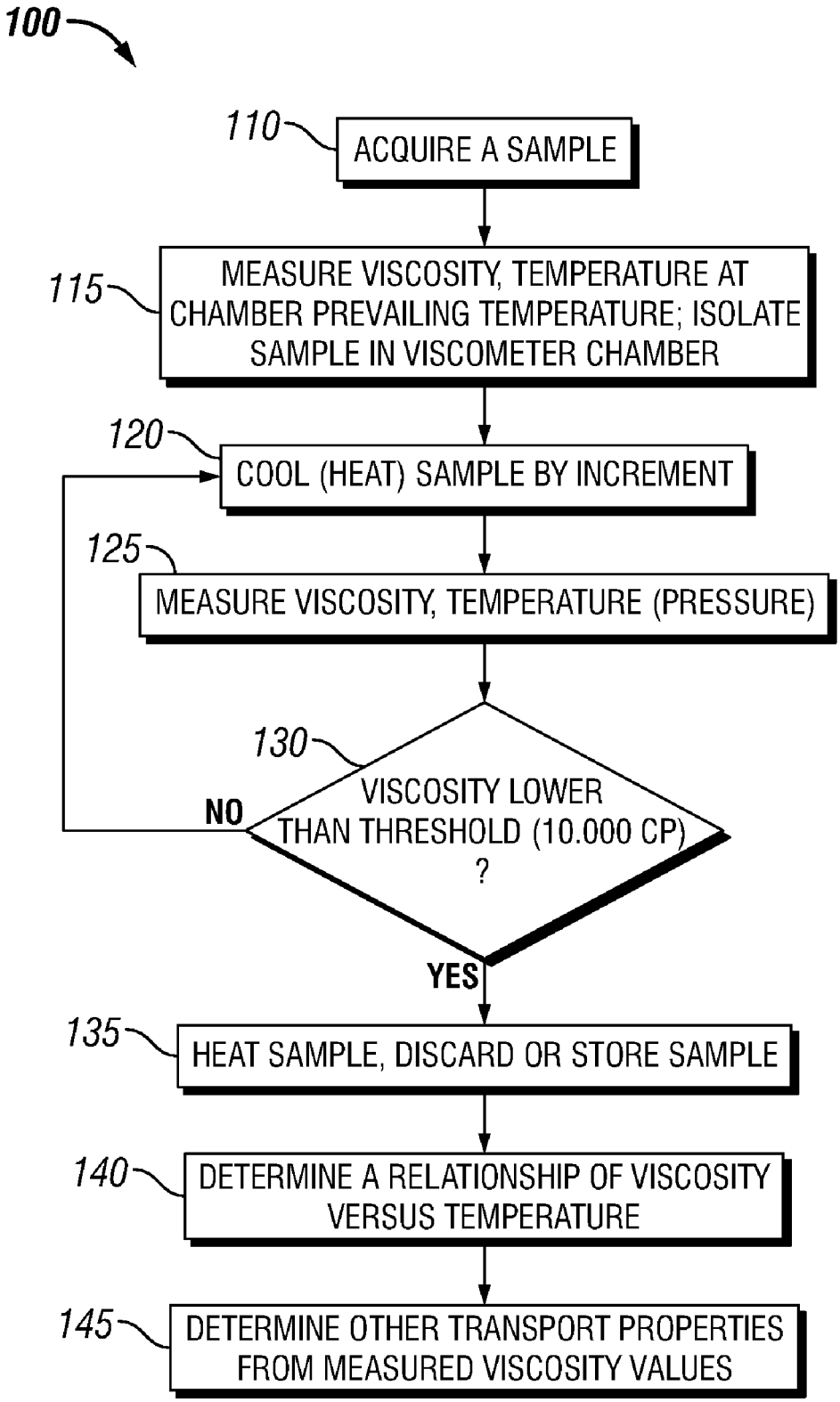
FIG. 2 is a flow chart of a method according to one or more aspects of the present disclosure.

FIG. 2 is a flow chart diagram of at least a portion of a method 100 of characterizing a formation fluid as a function of temperature according to one or more aspects of the present disclosure. The method 100 may be used for characterizing a heavy oil or bitumen reservoir, such as described above. In highly viscous reservoirs, viscosity of the formation hydrocarbon as a function of temperature may be of importance for the appraisal of a reserve and/or for selecting an energy efficient and environmentally acceptable production strategy, among other purposes. In addition, density, thermal conductivity, heat capacity at constant pressure, and thermal diffusivity may be used for the purpose of evaluating thermal recovery, and mass diffusion may be used for recovery methods based on the use of diluents (e.g., VAPEX). The method 100 provides measurements of the viscosity (and optionally density) at a plurality of temperatures. The method 100 may further utilize these viscosity values to obtain estimates of thermal conductivity and mass diffusion.

Referring to FIGS. 1 and 2, collectively, step 110 comprises mobilizing the formation fluid and acquiring a heavy oil sample within the formation tester 20. The heavy oil mobility enhancement may be achieved in such a manner that the sample chemical composition either represents the important characteristics of the reservoir fluid sufficiently well so that the physical properties are representative of the fluid in the reservoir, or that any physical characteristics that were modified during the sampling operation are reversible. For the sake of simplicity it is assumed in the following that the formation was stimulated by increasing, in a controlled manner, the temperature of a sufficient volume of formation about the formation tester and that the heated fluid received in the tool 20 has a viscosity on the order of 100 cP. In some embodiments, the temperature increase is constrained so that the oil is maintained at a temperature below that of the bubble pressure and of thermal decomposition.

At step 115, the viscosity and the temperature of the sample are monitored at the temperature and pressure conditions prevailing in the viscometer chamber 23. The viscosity may be measured with a flowline NMR sensor, a VW sensor and/or a DV-ROD sensor. The sensed viscosity and temperature values are then communicated to the controller 30. Optionally, a portion of the sampled fluid may be isolated in the viscosity chamber. For example, the fluid could be trapped between two valves (see FIG. 4).

At step 120, the temperature of the sample is changed. In one example, the isolated sample is cooled (or heated) by a decrement (increment) using the thermal pump 33. In another example, the heat generated by the electromagnetic transducer 31 is increased (or decreased) and a new aliquot is received in the viscometer chamber 23. In some cases, the controller 30 controls the heat transfer from devices 31 and/or 33 based on the temperature measured by the thermometer 32, such as to vary the temperature of the sample by a desired amount, for example in the first instance on the order of 1° K. In view of the sample being acquired by heating, and that further increases in temperature may result in either crossing the phase border or in thermal decomposition, it may be more desirable in some situations that the temperature of the sample be decreased.

At step 125 the viscosity $\eta$, the temperature T, and optionally the pressure p, of the sample are measured. These values are communicated to the controller 30.

At step 130, a test termination check is performed. For example, the temperature may be decreased until the viscosity has reached the maximum value obtainable from the viscometer (e.g., 10,000 cP). Further, an estimate of the derivative of the sample viscosity with respect to the temperature $d\eta/dT$ may be computed, and a temperature decrement (or increment) may be determined based on the computed derivative value. The temperature decrement (increment) may be determined so that at least four viscosity measurements $\eta(T, p)$ can be performed within the upper (or lower) operating range of the viscometer and of the cooling (heating) system. If the test termination criterion is not met, then the steps 120, 125 and 130 are repeated until at least four values of the viscosity $\eta(T,p)$ have been measured or the maximum operating viscosity or cooling (heating power) has been reached.

At optional step 135, if the sample was cooled, the fluid can be remobilized by heating to a temperature at which the viscosity is on the order of 100 cP or by heating to the initial temperature of the sample for example. Thus, the fluid can be ejected from the chamber 23. The ejected fluid may either be deployed into the wellbore or collected in a sample bottle for further analysis at surface. Optionally, the temperature, viscosity and pressure of the sample may be measured while heating, which may help ensure that at each temperature thermal equilibrium has been achieved prior to determining viscosity.

At step 140, a relationship between the measured viscosity and the measured temperature is determined. For example, the measurements may fit equations known to represent the temperature and or temperature and pressure dependence of viscosity. In particular, viscosity and temperature data may be correlated/fitted using Equations 1 or 2 (detailed below with respect to FIG. 3), depending on the form of the data $\eta(T)$ or $\eta(T, p)$, respectively. The determined relationship may be used to advantage for the evaluation of thermal production. The determined relationship may be used to advantage for interpolating and/or extrapolating viscosity to temperatures and pressures at which no measurement has been made.

At step 145, the measured viscosity values $\eta(T, p)$ may be used to infer, through empirical relationships, known models, physical principles and/or appropriate approximations thereof, other transport properties values, such as thermal conductivity values and mass (or self) diffusion values that are then self consistent with the measured viscosity values $\eta(T, p)$. These inferred transport properties may in turn be used to advantage in models of the thermal recovery of heavy oil for evaluating production strategies. Optionally, it may be useful to combine the measured viscosity values $\eta(T, p)$ with other measurements performed by the tool 20, such as density measurements, for example, to estimate transport properties of the sample fluid.

Examples of relationships, models and/or applicable physical principles reported in the literature can be found in *Transport Properties of Fluids: their Correlation, Estimation and Prediction*, by J. Millat, J. H. Dymond, and C. A. Nieto de Castro, published by Cambridge University Press, 1996. Other references include *The interpretation of transport coefficients on the basis of the Van der Waals model—1 dense fluids* by J. H. Dymond, published in Physica, 75, 1974, pp 100-114 and *Correlation and prediction of dense fluid transport—coefficients 1. normal-alkanes* by M. J. Assael, J. H. Dymond, M. Papadaki, and P. M. Patterson, published in Int. J. Thermophys., 13, 1992, pp 269-281, incorporated by reference herein in their entirety. There are some other publications that describe theories, some of which are based on assemblies of hard spheres.

In particular, semi-theoretical models can correlate or scale the viscosity of mixtures as a function of the pressure and temperature to a single, universal curve, function of a reduced volume parameter. The scaling parameters, namely a value of the volume parameter and a roughness parameter, also describe at least qualitatively other transport properties, such as thermal conductivity and mass (or self) diffusion, as Van der Waals forces are at the origin of these different properties of a same fluid. Thus, scaling the measured viscosity of the sample at a plurality of temperatures, and estimating the scaling parameters, provides a means of predicting thermal conductivity and diffusion coefficients.

Figure 3:
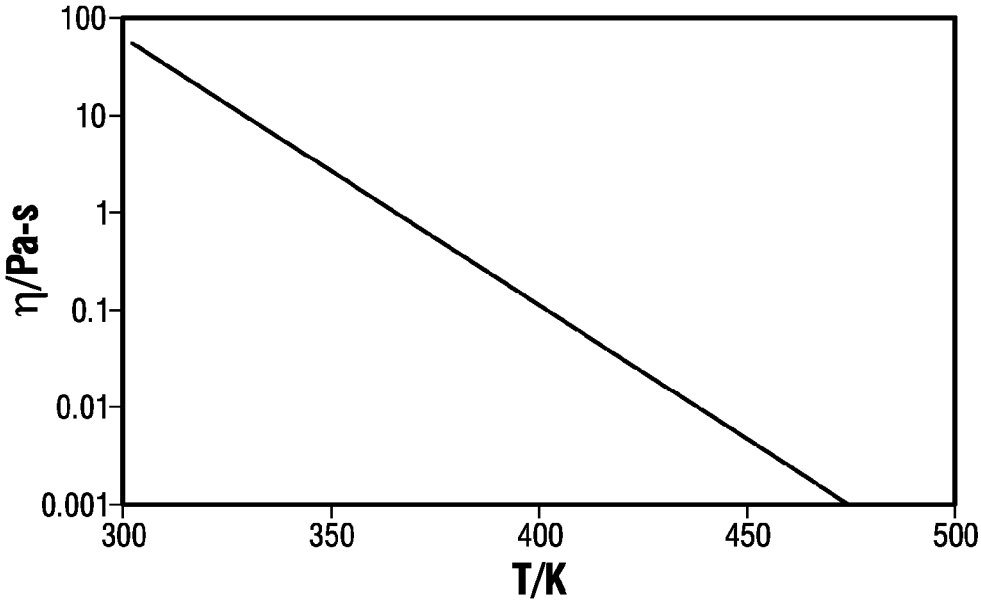
FIG. 3 is a graph of measured downhole fluid viscosity as a function of temperature.

FIG. 3 is a graph depicting a measured viscosity of a downhole fluid as a function of temperature. The example shown in FIG. 3 corresponds to the viscosity $\eta$ as a function of temperature T for Albanian oil of density 1024 $kg \cdot m^{-3}$ that is equal to 6.6 API gravity. This example assumes that there is no change in the composition of the fluid (i.e., the oil remains as single phase fluid).

At a pressure, the temperature T dependence of viscosity $\eta(T)$ is described by the empirical rule of Vogel as shown in Equation 1 below:

Equation 1

$$\eta(T)/\text{mPa}\cdot\text{s}=\exp[e+f/\{g+(T/K)\}]$$

In Equation 1, the parameters e, f and g are determined by adjustment to best represent measured values.

The effect of pressure on viscosity depends on, among other things, the chemical composition. An estimate of the effect of pressure on viscosity at constant temperature $(d\eta/dp)_T$ can be obtained and a pressure change of 10 MPa typically contributes on the order of an additional 0.001 Pa·s to the viscosity.

The viscosity $\eta(T, p)$ of a fluid can be represented by the empirical Vogel-Fulcher-Tammann (VFT) equation, which is expressed by an equation of the form of Equation 2 below with one or more variations in the number of parameters to best represent the measurements:

$$\eta(T, p)/mPa\cdot s = \exp\left\{a + b(p/MPa) + \frac{c + d(p/MPa) + e(p/MPa)^2}{(T/K) - T_0}\right\}, \quad \text{Equation 2}$$

In Equation 2, the six parameters a, b, c, d, e and $T_0$ are obtained by regression to measured viscosities.

Figure 4:
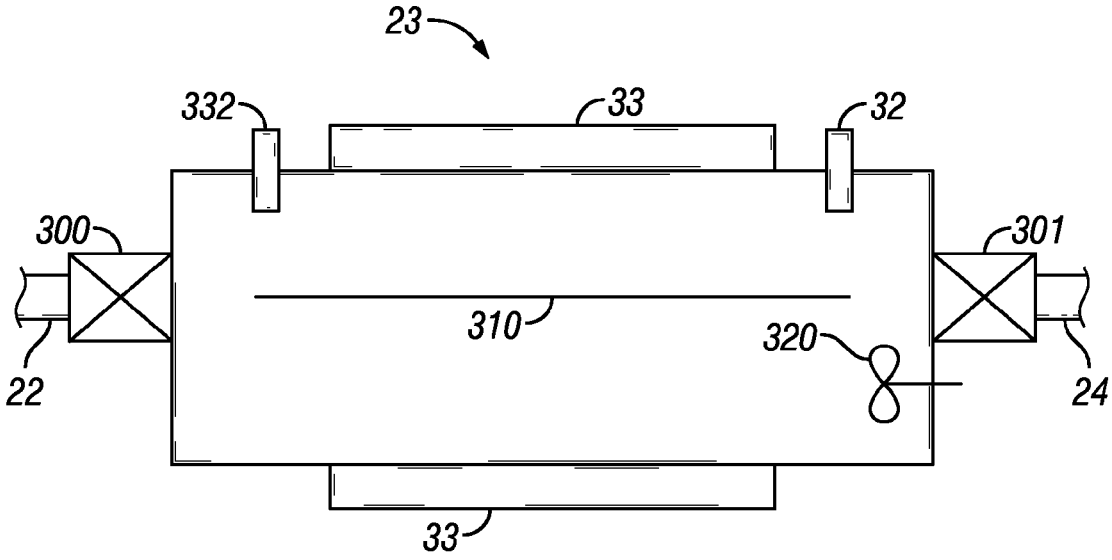
FIG. 4 is a schematic view of apparatus according to one or more aspects of the present disclosure.

FIG. 4 is a schematic view of an exemplary viscometer chamber 23 according to one or more aspects of the present disclosure, and that can be used in the fluid analysis tool 20 of FIG. 1. Referring to FIGS. 1 and 4, collectively, the viscometer chamber 23 is fluidly coupled to the flowline 22 for receiving a fluid sample from the formation 10. The viscosity chamber 23 is also fluidly coupled to the flowline 24 for discarding the fluid sample into the wellbore or into a sample container disposed in the tool 20 (not shown). To isolate at least a portion of the fluid sample, the viscosity chamber 23 is provided with optional sealing valves 300 and 301. The sealing valves may be selectively opened and closed by the controller 30.

To measure the temperature in the fluid in the chamber, the viscometer chamber 23 is provided with a thermometer 32, communicatively coupled to the controller 30. Optionally, the chamber 23 is provided with a pressure sensor (not shown) communicatively coupled to the controller 30 to measure the pressure of the fluid therein.

To measure the viscosity, in one embodiment, the chamber 23 is provided with a viscometer that might include a vibrating object such as a vibrating wire 310 (or a rod) that can, in the presence of a magnetic flux, be used to measure the viscosity. The operating range of the viscometer is a function of the wire diameter and the force required to move the wire length within a fluid when a current is passed through it in the presence of a magnetic flux. For example, a wire having a diameter on the order of 1 mm that is also on the order of 100 mm long that is exposed to a magnetic flux of the order of 1 T would measure viscosity up to 1600 cP. The viscometer is communicatively coupled to the controller 30. Measurements at higher viscosities can be achieved.

While the use of a vibrating wire viscometer has been detailed herein, the viscosity could be obtained with other viscometers that can be accommodated within a downhole sampling tool. Other viscometers include other vibrating objects including the DV-ROD and flowline NMR described above.

The chamber of the viscometer 23 is preferably a thermally insulated chamber that can be cooled or heated by a heat pump 33. The heat pump 33 may be implemented with a thermo-electric pump that operates by the Peltier effect. The heat pump 33 is selectively activated under the control of a thermostat, for example the controller 30, as needed to vary the temperature of the fluid sample isolated in the chamber 23 and in contact with the thermometer 32, the pressure sensor 332, and the vibrating wire 310.

To insure a homogenous fluid sample and uniform temperature inside the chamber, a mixer or agitator 320 may be provided in the chamber 23. The mixer or agitator 320 may be selectively actuated as needed.

Figure 5:
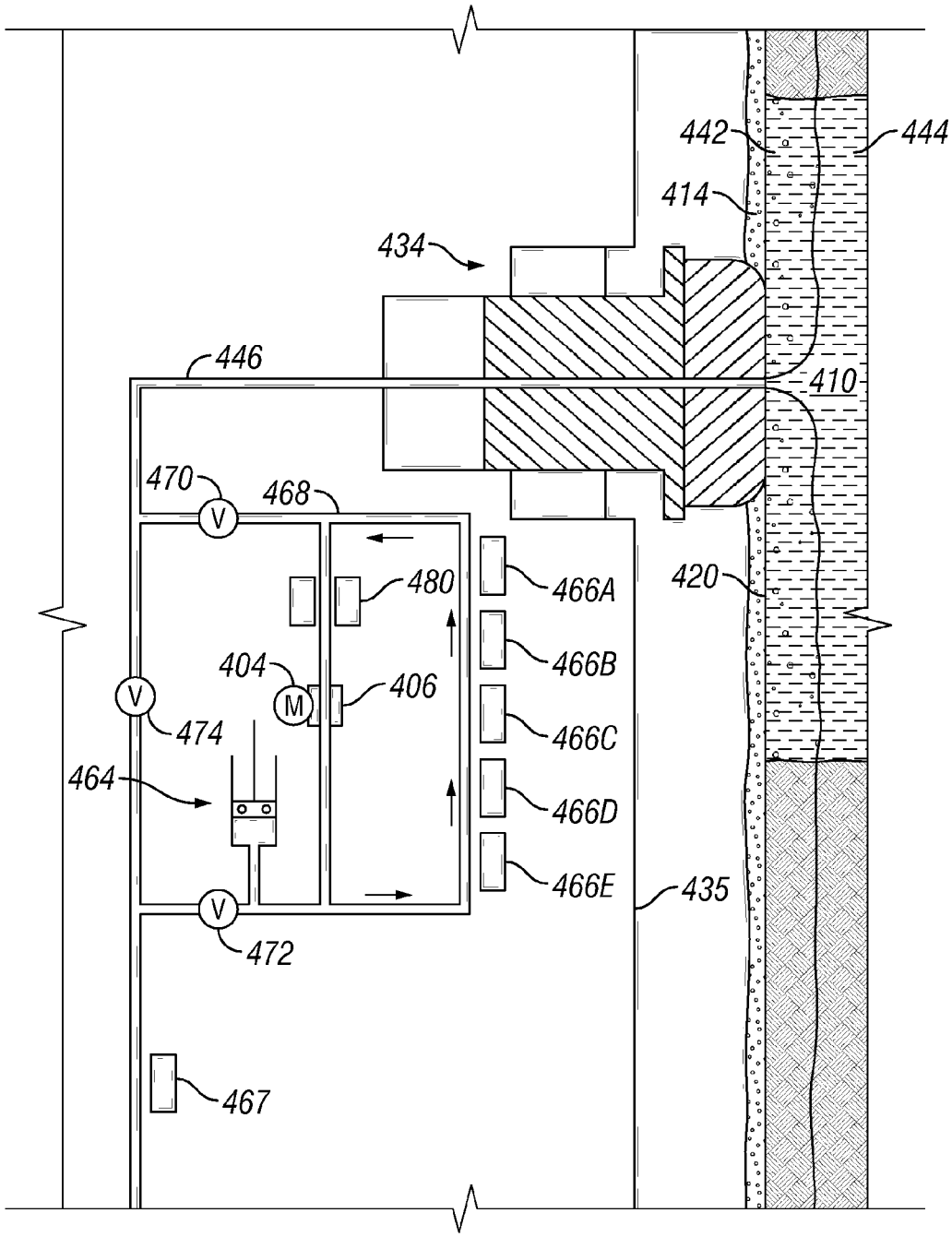
FIG. 5 is a schematic view of apparatus according to one or more aspects of the present disclosure.

FIG. 5 is a schematic view of a portion of another fluid analysis tool 435 according to one or more aspects of the present disclosure, and lowered in a borehole 420 drilled through a subterranean formation of interest 410. The tool 435 is capable of characterizing a formation fluid extracted from the formation 410 as a function of temperature as further detailed below. The tool 435 can be used to advantage for characterizing phase diagrams in gas and oil reservoirs, among other purposes.

The tool 435 is provided with an extendable probe 434 that is applied to the wall of the borehole 420 for receiving fluid samples into the tool 435. As shown in FIG. 5, the formation 410 may have been invaded by mud filtrate 442. The invaded zone spans between an impermeable mudcake 414 and a pristine zone 444. With the valves 470 and 472 closed and the valve 474 open, a pump (not shown) is used to extract the mud filtrate 442 from the formation 410 and into a flowline 446. The mud filtrate may be dumped into the borehole 420 until pristine formation fluid breaks though the invaded zone 442 and enters the downhole tool 435. When pristine formation fluid is detected in the downhole tool 435 by, for example, a contamination monitor 467 (e.g., an Optical Fluid Analyzer (OFA), trademark of Schlumberger), the valves 470 and 472 may be opened, and the valve 474 closed. Thus, pristine formation fluid may be received into an evaluation chamber 468. When the evaluation chamber 468 is filled with pristine formation fluid, the chamber 468 may be isolated by closing the valves 470 and 472.

In the example of FIG. 5, the chamber 468 is implemented with a circulation loop indicated by the arrows. The chamber 468 is provided with a motor 404 operatively coupled to a pump 406 disposed in a flow line of the chamber 468. The motor may be selectively activated to circulate the fluid isolated in the chamber 468. The circulation of fluid during a testing sequence may promote a homogeneous fluid and uniform temperature in the chamber 468, improving thereby the quality of data sensed by sensors 466*a*-466*e*.

The chamber 468 is provided with a heat pump 480 thermally coupled to the fluid therein to selectively vary the temperature of the fluid. The heat pump may be controlled by a thermostat (not shown) for operating the pump. Thus, the pump may be switched on or off, or gradually active, as desired. The chamber 468 is further provided with a syringe pump 464 fluidly coupled thereto to selectively vary the pressure of the fluid therein.

The chamber 468 is further provided with sensors 466*a-e*, capable of sensing one or more properties of the fluid therein. For example, the sensors 466*a-e* may include, but are not restricted to, a thermometer, a pressure sensor, a density sensor, a viscosity sensor, an OFA or any other downhole fluid spectrometer. The physicochemical properties, which include thermophysical properties, of the fluid sample received in the evaluation chamber 468 can be measured within the formation tester 435. The data collected by the sensors 466*a-e* are communicated to a downhole or uphole controller (not shown) for storage, processing, and/or display to an operator. In particular, the data collected by the sensor may be used to advantage to determine a phase diagram as shown in FIG. 6.

Figure 6:
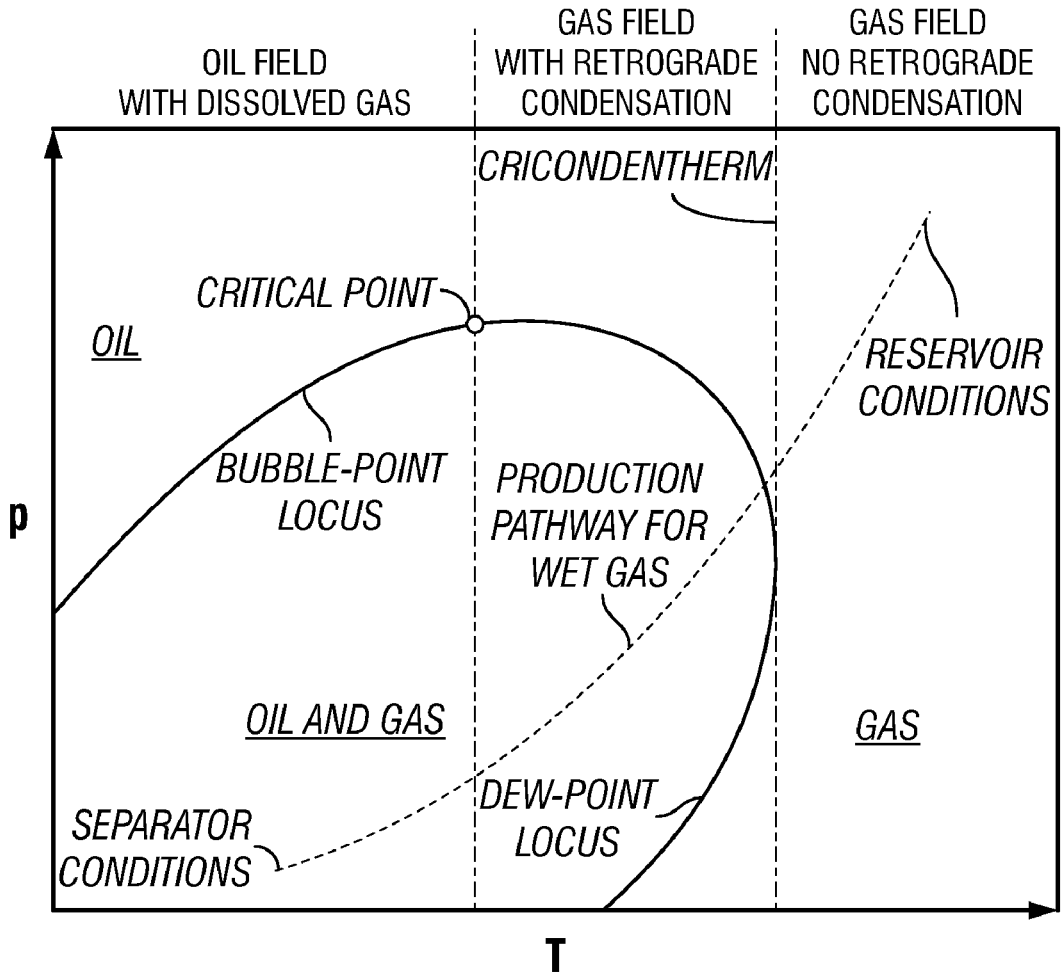
FIG. 6 is a phase diagram of a formation fluid as a function of temperature and pressure.

FIG. 6 shows a graph depicting a phase diagram of a formation fluid as a function of temperature and pressure. In particular, FIG. 6 shows a pressure (p) and temperature (T) graph indicating the cricondentherm value and phase boundary curve of one particular formation hydrocarbon. Depending on the in situ pressure and temperature of the formation hydrocarbon in the reservoir, the temperatures at which the reservoir would be characterized as including volatile oil, gas condensates and gas without condensate, are also shown. The production pathway for a wet gas is also shown. The determination of the phase boundary curves of one particular downhole fluid as well as the in-situ conditions (pressure and temperature) of this downhole fluid are important parameters for designing exploitation facilities of underground hydrocarbon reservoirs.

Figure 7:
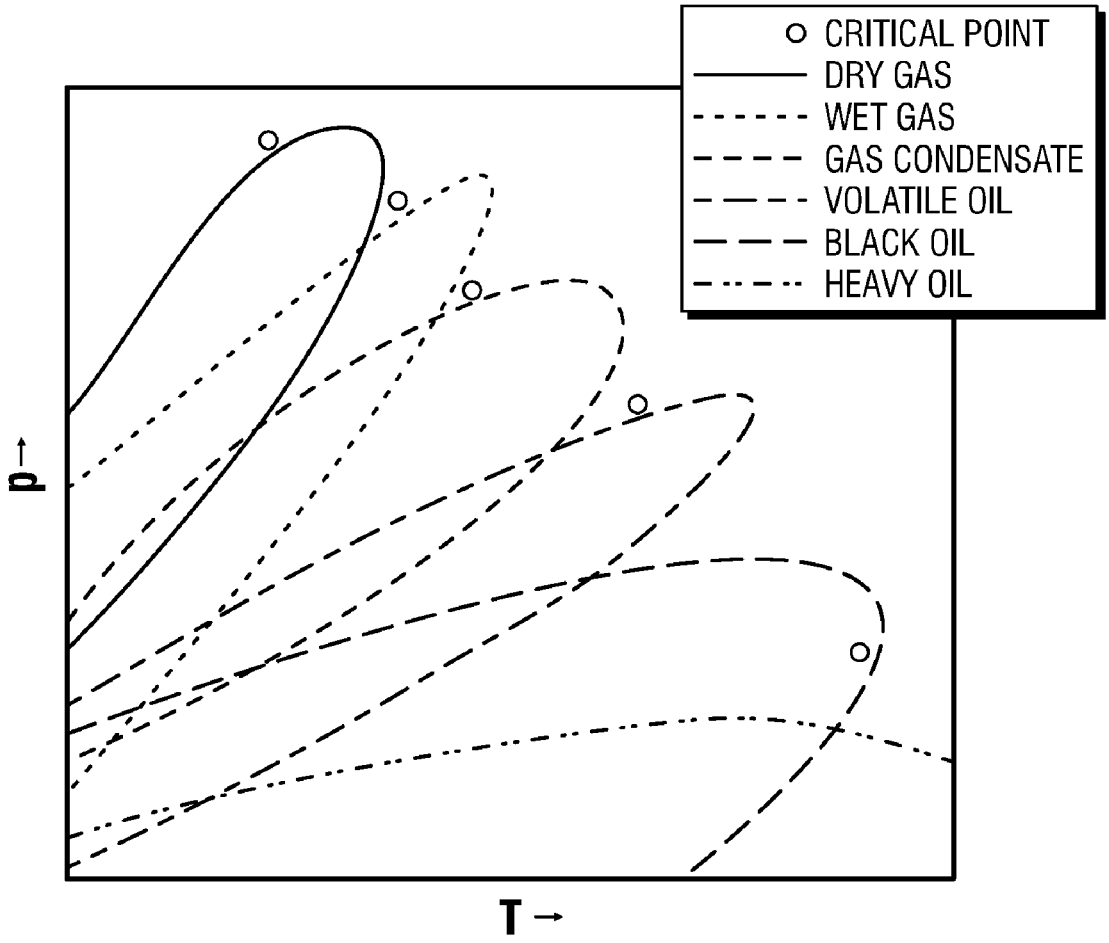
FIG. 7 is a (p, T) section at constant composition for a liquid reservoir fluid.

The variation of (p, T) section for differing hydrocarbon types commonly found are shown in FIG. 7. That is, FIG. 7 is a (p, T) section at constant composition for a liquid reservoir fluid showing bubble curve, at dew curve, and temperatures, relative to the critical point, at which liquid oil and gas coexist. Except for so-called black and heavy oils the bubble curve commences at temperature immediately below critical while the dew curve commences at temperatures immediately above critical and after increasing, reaches a maximum and then decreases albeit at pressures lower than the corresponding bubble pressure at the same temperature. For black oil the dew temperatures occur at temperatures immediately below critical. Bitumen is effectively a solid.

Referring to FIGS. 5 and 6, collectively, the tool 435 may be used to receive a sample of hydrocarbon from an underground reservoir in an evaluation chamber 468. The temperature and/or the pressure of the sample may be selectively varied and measured as the tool 468 is still downhole, for example following a production pathway as shown. Simultaneously, or essentially simultaneously, a physiochemical property of the sample may also be measured. The phase boundary curve of the sampled fluid may be determined by analyzing the values of the measured property as a function of temperature and/or pressure. In particular, points of the bubble point locus curve and dew point locus curves may be determined by indentifying rapid variations of viscosity and/or density.

From the foregoing, it will be appreciated that the present disclosure introduces a downhole tool capable of measuring, in-situ formation, the values of thermophysical property of a downhole fluid at a plurality of temperatures, as well as methods of downhole characterization of formation fluid as a function of temperature. In some embodiments, such tools and methods are configured for use during the appraisal of highly viscous reservoirs (e.g., heavy oil reservoirs, bitumen reservoir, tar sands, oil shale and the like). Those skilled in the art will appreciate the significance of heavy oil as a source of energy and acknowledge that the high viscosity of heavy oil requires means of production and sampling that differ from the majority of conventional oil production means. In particular, the viscosity of the formation hydrocarbon as a function of temperature is important for evaluating the economical viability of thermal recovery. Furthermore, mass diffusion as a function of temperature is important for evaluating the migration of vapor during vapor extraction processes (VAPEX), or other recovery processes involving heated diluents. In other embodiments, such tools and methods are capable of being used for characterizing phase diagrams in gas and oil reservoirs.

In view of all of the above and FIGS. 1-7, it should be readily apparent to those skilled in the art that the present disclosure provides a fluid analysis tool, for use in a borehole formed in a subterranean formation, and comprising a chamber configured to receive fluid from the subterranean formation, a thermostat configured to selectively vary a temperature of the fluid, a thermometer configured to measure a temperature of the fluid received in the chamber, a sensor configured to measure a thermophysical property of the fluid received in the chamber, and a controller configured to determine a relationship between the temperature and the thermophysical property of the fluid received in the chamber. The thermostat may be configured to selectively raise and/or lower the temperature of the fluid received in the chamber. The thermostat may comprise a heat pump. The sensor may be or comprise a viscometer. The fluid analysis tool may further comprise electromagnetic transducers configured to increase the mobility of the formation fluid.

The present disclosure also introduces a fluid analysis tool, for use in a borehole formed in a subterranean formation, and comprising means for selectively varying a temperature of fluid received in the tool from the subterranean formation, means for measuring a temperature and a thermophysical property of the fluid received in the tool, and means for determining a relationship between the measured temperature and the measured thermophysical property of the fluid received in the tool. The selective temperature varying means may be configured to selectively raise and/or lower the temperature of the fluid received in the tool. The selective temperature varying means may be or comprise a heat pump. The measuring means may be or comprise a viscometer. The fluid analysis tool may further comprise means for increasing mobility of fluid in the subterranean formation prior to the fluid being received in the tool.

The present disclosure also provides a method of analyzing fluid in a tool conveyed in a borehole formed in a subterranean formation. In at least one embodiment, such method comprises selectively varying a temperature of a formation fluid, receiving the formation fluid in a chamber disposed in the tool, measuring a thermophysical property of the formation fluid at each of a plurality of different temperatures, and determining a temperature dependence of the thermophysical property of the formation fluid based on the measured thermophysical property of the formation fluid at each of the plurality of different temperatures. The formation fluid may comprise heavy oil and/or bitumen. The thermophysical property of the formation fluid may be a viscosity. The method may further comprise increasing mobility of the formation fluid prior to receiving the formation fluid in the chamber. Increasing mobility of the formation fluid may comprise exposing the formation fluid to electromagnetic energy. Receiving the formation fluid in the chamber may comprise receiving the formation fluid in the chamber prior to selectively varying the temperature of the formation fluid, such that selectively varying the temperature of the formation fluid comprises selectively varying the temperature of the formation fluid after the formation fluid is received in the chamber. The method may further comprise measuring a pressure of the formation fluid received in the chamber at each of the plurality of temperatures, wherein determining the temperature dependence of the thermophysical property of the formation fluid comprises determining a temperature and pressure dependence of the thermophysical property of the formation fluid. The method may further comprise reversing the formation fluid temperature variation performed in the chamber and then expelling the formation fluid from the chamber.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the scope of the present disclosure, and that they may make various changes, substitutions and alterations herein without departing from the scope of the present disclosure.

What is claimed is:

1. A method of analyzing fluid in a tool conveyed in a borehole formed in a subterranean formation, comprising:

selectively varying a temperature of a formation fluid;

receiving the formation fluid in a chamber disposed in the tool;

measuring a thermophysical property of the formation fluid at each of a plurality of different temperatures;

determining a temperature dependence of the thermophysical property of the formation fluid based on the measured thermophysical property of the formation fluid at each of the plurality of different temperatures; and reversing the formation fluid temperature variation performed in the chamber and then expelling the formation fluid from the chamber.

2. The method of claim 1 wherein the formation fluid comprises heavy oil.

3. The method of claim 1 wherein the formation fluid comprises bitumen.

4. The method of claim 1 wherein the formation fluid comprises heavy oil and bitumen.

5. The method of claim 1 wherein the thermophysical property of the formation fluid is a viscosity.

6. The method of claim 1 further comprising increasing mobility of the formation fluid prior to receiving the formation fluid in the chamber.

7. The method of claim 6 wherein increasing mobility of the formation fluid comprises exposing the formation fluid to electromagnetic energy.

8. The method of claim 1 wherein receiving the formation fluid in the chamber comprises receiving the formation fluid in the chamber prior to selectively varying the temperature of the formation fluid, such that selectively varying the temperature of the formation fluid comprises selectively varying the temperature of the formation fluid after the formation fluid is received in the chamber.

9. The method of claim 1 further comprising measuring a pressure of the formation fluid received in the chamber at each of the plurality of temperatures, wherein determining the temperature dependence of the thermophysical property of the formation fluid comprises determining a temperature and pressure dependence of the thermophysical property of the formation fluid.

* * * * *